US008519919B2

(12) United States Patent
Uchino et al.

(10) Patent No.: US 8,519,919 B2
(45) Date of Patent: Aug. 27, 2013

(54) DISPLAY DEVICE AND METHOD TO PREVENT THE CHANGE OF THRESHOLD VOLTAGE OF THE WRITING TRANSISTOR DUE TO THE VARIATION WITH AGE

(75) Inventors: Katsuhide Uchino, Kanagawa (JP); Tetsuro Yamamoto, Kanagawa (JP); Takayuki Taneda, Kanagawa (JP)

(73) Assignee: Sony Corporation, Tokyo (JP)

( * ) Notice: Subject to any disclaimer, the term of this patent is extended or adjusted under 35 U.S.C. 154(b) by 689 days.

(21) Appl. No.: 12/216,082

(22) Filed: Jun. 30, 2008

(65) Prior Publication Data

US 2009/0033652 A1 Feb. 5, 2009

(30) Foreign Application Priority Data

Jul. 30, 2007 (JP) ..... 2007-197081

(51) Int. Cl.
*G09G 3/30* (2006.01)

(52) U.S. Cl.
USPC ..... 345/78

(58) Field of Classification Search
USPC ..... 345/77, 78
See application file for complete search history.

(56) References Cited

U.S. PATENT DOCUMENTS

| | | | | |
|---|---|---|---|---|
| 5,684,365 | A | 11/1997 | Tang et al. | |
| 2004/0174349 | A1* | 9/2004 | Libsch et al. | 345/204 |
| 2005/0083270 | A1* | 4/2005 | Miyazawa | 345/76 |
| 2005/0269959 | A1* | 12/2005 | Uchino et al. | 315/169.3 |
| 2006/0061560 | A1* | 3/2006 | Yamashita et al. | 345/204 |
| 2006/0066530 | A1* | 3/2006 | Azami et al. | 345/76 |
| 2006/0170628 | A1* | 8/2006 | Yamashita et al. | 345/76 |
| 2006/0187154 | A1* | 8/2006 | Tsuchida | 345/76 |
| 2006/0267884 | A1* | 11/2006 | Takahashi et al. | 345/76 |
| 2007/0115224 | A1* | 5/2007 | Yamamoto et al. | 345/76 |
| 2007/0115225 | A1* | 5/2007 | Uchino et al. | 345/76 |
| 2007/0268210 | A1* | 11/2007 | Uchino et al. | 345/55 |
| 2007/0273620 | A1* | 11/2007 | Yumoto | 345/76 |

(Continued)

FOREIGN PATENT DOCUMENTS

| | | | |
|---|---|---|---|
| JP | 08-234683 | A | 9/1996 |
| JP | 2003-271095 | A | 9/2003 |
| JP | 2004-118132 | A | 4/2004 |
| JP | 2006-208966 | A | 8/2006 |
| JP | 2008-033193 | A | 2/2008 |
| WO | WO2007055376 | * | 5/2007 |

OTHER PUBLICATIONS

Japanese Office Action issued Mar. 6, 2012 for corresponding Japanese Patent No. 2007-197081.

*Primary Examiner* — Chanh Nguyen
*Assistant Examiner* — Robert Stone
(74) *Attorney, Agent, or Firm* — Rader, Fishman & Grauer PLLC

(57) ABSTRACT

A display device includes a display portion formed by disposing pixels in matrix, in which the pixel includes: a light emitting element; a signal level holding capacitor; a writing transistor for receiving a write signal from the vertical drive circuit, and being turned ON/OFF by the write signal, thereby setting a voltage across the terminals of the signal level holding capacitor at a signal level on a signal line; and a driving transistor for driving the light emitting device; and the vertical drive circuit sets a signal level of the write signal for an entire or partial time period of a time period for which the drive for the light emitting device is not influenced in a non-emission time period for which light emission of the light emitting device is stopped at a signal level of the write signal on a shorter time period side in other time periods.

4 Claims, 13 Drawing Sheets

(56) References Cited

U.S. PATENT DOCUMENTS

2008/0018629 A1* 1/2008 Uchino et al. ..... 345/205
2008/0030436 A1* 2/2008 Iida et al. ..... 345/77
2008/0111774 A1* 5/2008 Iida et al. ..... 345/76
2008/0198103 A1* 8/2008 Toyomura et al. ..... 345/77
2008/0225027 A1* 9/2008 Toyomura et al. ..... 345/204
2008/0246747 A1* 10/2008 Taneda et al. ..... 345/204

* cited by examiner

DISPLAY DEVICE AND METHOD TO PREVENT THE CHANGE OF THRESHOLD VOLTAGE OF THE WRITING TRANSISTOR DUE TO THE VARIATION WITH AGE

CROSS REFERENCES TO RELATED APPLICATIONS

The present invention contains subject matter related to Japanese Patent Application JP 2007-197081 filed in the Japan Patent Office on Jul. 30, 2007, the entire contents of which being incorporated herein by reference.

BACKGROUND OF THE INVENTION

1. Field of the Invention

The present invention relates to a display device and a method of driving the same, and can be applied to an active matrix type display device having pixels each of which is composed of an organic Electro Luminescence (EL) device, for example, using a polysilicon Thin Film Transistor (TFT). The present invention is made such that a signal level of a write signal for an entire time period or a partial time period of a time period for which no influence is exerted on the drive for a light emitting device at all within a non-emission time period for which the light emitting device is stopped to emit a light is set at a signal level on a short time period side in other time periods except for the entire time period or the partial time period, thereby making it possible to effectively avoid a phenomenon that an image quality deteriorates due to a variation with age, and gradation cannot be set.

2. Description of the Related Art

In related art, the various techniques have been proposed for the display devices each of which is composed of the organic EL devices. These various techniques, for example, are described in U.S. Pat. No. 5,684,365, and Japanese Patent Laid-Open No. Hei 8-234683.

Here, FIG. 2 is a block diagram showing a so-called active matrix type display device, in the related art, using organic EL devices. In this active matrix type display device 1, a display portion 2 is formed by disposing pixels 3 in a matrix. In addition, in the display portion 2, scanning lines SCNs are horizontally distributed in units of lines for the pixels disposed in a matrix, and a signal line SIG is distributed every column so as to be perpendicular to the scanning lines SCNs.

Here, as shown in FIG. 3, each of the pixels 3 is composed of an organic EL device 8 as a current drive type self-light emitting device, and a drive circuit, of corresponding one of the pixels 3, for driving the organic EL device 8 (hereinafter referred to as "a pixel circuit").

In the pixel 3, one terminal of a signal level holding capacitor C1 is held at a given potential, and the other terminal of the signal level holding capacitor C1 is connected to the signal line SIG through an transistor TR1 which is turned ON or OFF by a write signal WS. As a result, in the pixel 3, the transistor TR1 is turned ON in accordance with the rising of the write signal WS, and the potential at the other terminal of the signal level holding capacitor C1 is set at the signal level on the signal line SIG. In addition, the signal level on the signal line SIG is sampled and held at the other terminal of the signal level holding capacitor C1 with timing at which the transistor TR1 is switched from the ON state over to the OFF state.

In the pixel 3, the other terminal of the signal level holding capacitor C1 is connected to a gate of a P-channel TFT transistor TR2 having a source connected to a power source Vcc, and a drain of the transistor TR2 is connected to an anode of the organic EL device 8. Here, the pixel 3 is set such that the transistor TR2 usually operates in a saturation region. As a result, the transistor TR2 constitutes a constant current circuit based on a drain to source current Ids expressed by the following Expression (1):

$$I_{ds} = \frac{1}{2}\mu\frac{W}{L}C_{ox}(V_{gs} - V_{th})^2 \quad (1)$$

Where Vgs is a gate to source voltage of the transistor TR2, μ is a mobility, W is a channel width, L is a channel length, Cox is a capacity obtained based on a gate insulating film per unit area, and Vth is a threshold voltage of the transistor TR2. As a result, in each of the pixels 3, the organic EL device 8 is driven by the drive current Ids (drain to source current) corresponding to the signal level on the signal line SIG sampled and held in the signal level holding capacitor C1.

In the display device 1, predetermined sampling pulses are successively transferred by a write scanning circuit (WSCN) 4A of a vertical drive circuit 4 to generate write signals WS as timing signals to make instructions to successively write data to the pixels 3. In addition, predetermined sampling pulses are successively transferred by a horizontal selector (HSEL) 5A of a horizontal drive circuit 5 to successively generate timing signals. Also, each of the signal lines SIG is set at a signal level of an input signal S1 with each of the timing signals as a reference. As a result, the display device 1 sets a voltage across the terminals of the signal level holding capacitor C1 provided in the display portion 2 in accordance with the input signal S1, thereby displaying thereon an image corresponding to the input signal S1 in a dot-sequential or line-sequential manner.

Here, as shown in FIG. 4, current-voltage characteristics of the organic EL device 8 changes over time in a direction of causing a current to hardly flow due to the long term use. It is noted that in FIG. 4, a curve indicated by reference symbol L1 represents the initial current-voltage characteristics, and a curve indicated by reference symbol L2 represents the current-voltage characteristics due to the variation with age. However, when the organic EL device 8 is driven by the P-channel TFT transistor TR2 in the circuit configuration shown in FIG. 3, the transistor TR2 drives the organic EL device 8 in accordance with the gate to source voltage Vgs set in accordance with the signal level on the signal line SIG, thereby making it possible to prevent the luminance change in each of the pixels due to the variation with age of the current-voltage characteristics.

Now, when all the transistors constituting the pixel circuits, the horizontal drive circuit, and the vertical drive circuit are configured in the form of N-channel TFT transistors, these circuits can be collectively formed on an insulating substrate such as a glass substrate in the amorphous silicon process. As a result, the display device can be simply manufactured.

However, as shown in FIG. 5 in comparison with FIG. 3, when an N-channel TFT transistor is applied to the transistor TR2 to form each of pixels 13, and thus a display device 11 is composed of a display portion 12 having the pixels 13 formed therein, connecting a source of the transistor TR2 to the organic EL device 8 results in the problem that the gate to source voltage Vgs of the transistor TR2 changes due to the change in current-voltage characteristics shown in FIG. 4. As a result, in this case, the current flowing through the organic EL device 8 gradually decreases due to the long term use, which results in the problem that the emission luminance of the organic EL device 8 is reduced step by step. In addition, with the circuit configuration shown in FIG. 5, the emission luminance disperses every pixel due to the dispersion in the characteristics of the transistor TR2. It is noted that the dispersion in the emission luminance disturbs the uniformity in the displayed picture, and the disturbance is perceived in the form of color heterogeneity or roughness of the displayed picture.

For this reason, it is expected to configure each of pixels, for example, as shown in FIG. 6 as the technique for preventing the dispersion in the emission luminance due to the reduction in the emission luminance, and the dispersion in the characteristics which are caused by such a variation with age of the organic EL device.

Here, in a display device 21 shown in FIG. 6, a display portion 22 is formed by disposing pixels 23 in a matrix. In the pixel 23, one terminal of the signal level holding capacitor C1 is connected to the anode of the organic EL device 8. Also, the other terminal of the signal level holding capacitor C1 is connected to the signal line SIG through the transistor TR1 which is turned ON or OFF in accordance with the write signal WS. As a result, in the pixel 23, the voltage at the other terminal of the signal level holding capacitor C1 is set at the signal level on the signal line SIG in accordance with the write signal WS.

In the pixel 23, both terminals of the signal level holding capacitor C1 are connected to the source and the gate of the transistor TR2, respectively. Also, the drain of the transistor TR2 is connected to the scanning line SCN for supply of a power source voltage. As a result, in the pixel 23, the organic EL device 8 is driven by the transistor TR2 having a source follower circuit configuration in which the gate voltage is set at the signal level on the signal line SIG. It is noted that reference symbol Vcat designates a cathode potential of the organic EL device 8.

In the display circuit 21, a write scanning circuit (WSCN) 24A and a drive scanning circuit (DSCN) 24B of a vertical drive circuit 24 output a write signal WS and a drive signal DS for the power source to the scanning lines SCNs, respectively. In addition, a horizontal selector (HSEL) 25A of a horizontal drive circuit 25 outputs a drive signal Ssig to the signal line SIG. An operation of the pixel 23 is controlled in such a manner.

Here, FIGS. 7A to 7E are a time chart explaining the operation of the pixel 23. In the pixel 23, for an emission time period as a time period for which the organic EL device 8 emits a light, as shown in FIG. 8, the transistor TR1 is set in the OFF state by the write signal WS, and the power source voltage Vcc is supplied to the transistor TR2 by the drive signal DS (refer to FIGS. 7A and 7B). As a result, the gate voltage Vg and the source voltage Vs (refer to FIGS. 7D and 7E) of the transistor TR2 are held at the voltages at the both terminals of the signal level holding capacitor C1, respectively. Thus, the organic EL device 8 is driven by a drive signal Ids based on the gate voltage Vg and the source voltage Vs. It is noted that the drive signal Ids is expressed by Expression (1).

In the pixel 23, when the emission time period is completed, as shown in FIG. 9, the drain voltage of the transistor TR2 is dropped to a predetermined voltage Vss by the drive signal DS. Here, the predetermined voltage Vss is set at a voltage lower than a voltage obtained by adding the cathode voltage Vcat of the organic EL device 8 to a threshold voltage Vth of the organic EL device 8. As a result, the drive signal DS side of the transistor TR2 for drive functions as a source, and an anode voltage (Vs in FIG. 7E) of the organic EL device 8 rises, so that the organic EL device 8 stopped to emit the light.

At this time, in the pixel 23, as indicated by an arrow in FIG. 9, the accumulated charges are discharged from the organic EL device 8 side terminal of the signal level holding capacitor C1, whereby the anode voltage of the organic EL device 8 drops to be set at the voltage Vss.

Subsequently, in the pixel 23, as shown in FIG. 10, the signal level on the signal line SIG is dropped to a predetermined voltage Vofs by the drive signal Ssig, and the transistor TR1 is switched from the OFF state over to the ON state by the write signal WS (refer to FIGS. 7A and 7C). As a result, in the pixel 23, the gate voltage Vg of the transistor TR2 is set at the voltage Vofs of the signal line SIG, and the gate to source voltage Vgs of the transistor TR2 is set at (Vofs−Vss). Here, when a threshold voltage of the transistor TR2 is Vth, the voltage Vofs is set such that the gate to source voltage Vgs of the transistor TR2 is larger than the threshold voltage Vth of the transistor TR2.

Subsequently, for a time period designated by reference symbol Tth1 in FIGS. 7A to 7E, as shown in FIG. 11, the drain voltage of the transistor TR2 is dropped to the power source voltage Vcc by the drive signal DS in a state in which the transistor TR1 is held in the ON state. As a result, in the pixel 23, when the voltage across the terminals of the signal level holding capacitor C1 is larger than the threshold voltage of the transistor TR2, as indicated by an arrow in FIG. 11, a charge current flows from the power source Vcc into the organic EL device 8 side terminal of the signal level holding capacitor C1, so that a voltage Vs at the organic EL device 8 side terminal of the signal level holding capacitor C1 gradually rises. Here, an equivalent circuit of the organic EL device 8 is expressed in the form of a parallel circuit of a diode and a capacitor Cel. Here, in the state shown in FIG. 11, the current flows from the power source Vcc into the organic EL device 8 as well through the transistor TR2. However, a leakage current of the organic EL device 8 is considerably smaller than the current flowing through the transistor TR2 as long as the voltage across the terminals of the organic EL device 8 exceeds the threshold voltage of the organic EL device 8 due to the rise of the source voltage of the transistor TR2. Therefore, the current flowing into the organic EL device 8 is used to charge the signal level holding capacitor C1 and the capacitor Cel of the organic EL device 8 with electricity. As a result, in the pixel 23, the organic EL device 8 emits no light at all, and only the source voltage of the transistor TR2 merely rises.

Subsequently, in the pixel 23, the transistor TR1 is switched from the ON state over to the OFF state by the write signal WS, and the signal level of the signal on the signal line SIG is set at a signal level Vsig representing the gradation of the corresponding pixel belonging to the signal line adjacent to the signal line SIG but one. As a result, in the pixel 23, the charge current continuously flows from the power source Vcc into the organic EL device 8 side terminal of the signal level holding capacitor C1 through the transistor TR2, so that the source voltage Vs of the transistor TR2 continues to rise. In addition, in this case, the gate voltage Vg of the transistor TR2 rises so as to follow the rise in the source voltage Vs of the transistor TR2. It is noted that the signal level Vsig on the signal line SIG for this time period is used to set the gradation for the corresponding pixel belonging to the signal line adjacent to the signal line SIG but one.

In the pixel 23, after a lapse of a given time, the signal level on the signal line SIG is switched over to the voltage Vofs again. As a result, for a time period designated by reference symbol Tth2 in FIGS. 7A to 7E, when the voltage across the terminals of the signal level holding capacitor C1 is larger than the threshold voltage of the transistor TR2 in the state in which the signal line SIG side potential of the signal level holding capacitor C1 is held at the voltage Vofs, the charge current flows from the power source Vcc into the organic EL device 8 side terminal of the signal level holding capacitor C1 through the transistor TR2, so that the source voltage Vs of the transistor TR2 gradually rises. As a result, as shown in FIG. 12, the source voltage Vs of the transistor TR2 rises step by step so that the gate to source voltage Vgs of the transistor TR2 approaches the threshold voltage Vth of the transistor TR2. Also, when the gate to source voltage Vgs of the transistor TR2 comes to be equal to the threshold voltage Vth of the transistor TR2, the inflow of the charge current into the organic EL device 8 side terminal of the signal level holding capacitor C1 through the transistor TR2 is stopped.

In the pixel 23, the processing for the inflow of the charge current into the organic EL device 8 side terminal of the signal level holding capacitor C1 through the transistor TR2 is repeatedly executed given times enough for the gate to source voltage Vgs of the transistor TR2 to come to be equal to the threshold voltage Vth of the transistor TR2 (three times designated by reference numerals Tth1, Tth2 and Tth3 in the example shown in FIGS. 7A to 7E). As a result, as shown in FIG. 13, the threshold voltage Vth of the transistor TR2 is set in the signal level holding capacitor C1. It is noted that in the pixel 23, the voltages Vofs and Vcat are set so that a relationship of $Vel=Vofs-Vth<Vcat+Vthel$ where Vthel is a threshold voltage of the organic EL device 8 is obtained in a state in which the threshold voltage Vth of the transistor TR2 is set in the signal level holding capacitor C1. As a result, the setting is performed so that the organic EL device 8 emits no light at all.

After that, in the pixel 23, the potential at the signal line SIG side terminal of the signal level holding capacitor C1 is set at the voltage Vsig representing the emission luminance of the organic EL device 8, whereby the voltage representing the gradation is set in the signal level holding capacitor C1 so as to cancel the threshold voltage Vth of the transistor TR2. As a result, there is prevented the dispersion in the emission luminance due to the dispersion in the threshold voltage Vth of the transistor TR2.

That is to say, as shown in FIG. 14, in the pixel 23, after a lapse of the time period Tth3, the signal level on the signal line SIG is set at the signal level Vsig representing the emission luminance of the pixel 23 concerned. Subsequently, as shown by a time period Tμ, the transistor TR1 is set in the ON state by the write signal WS. As a result, in the pixel 23, the signal level at the signal line SIG side terminal of the signal level holding capacitor C1 is set at the signal level Vsig on the signal line SIG. Also, the current corresponding to the gate to source voltage Vgs based on the voltage across the terminals of the signal level holding capacitor C1 flows from the power source Vcc into the signal level holding capacitor C1 side terminal of the organic EL device 8 through the transistor TR2. As a result, the source voltage Vs of the transistor TR2 gradually rises.

Here, the current flowing from the power source Vcc into the signal level holding capacitor C1 side terminal of the organic EL device 8 through the transistor TR2 changes in accordance with a mobility of the transistor TR2. Thus, as shown in FIG. 15, the rise speed of the source voltage Vs increases with an increase in mobility of the transistor TR2. In addition, the current flowing through the transistor TR2 for driving the organic EL device 8 while the organic EL device 8 emits the light also increases depending on the mobility of the transistor TR2. Thus, there is a disadvantage that the dispersion in the threshold voltage Vth and the dispersion in the mobility μ are large because this sort of transistor TR2 is a polysilicon TFT or the like.

Thus, in the pixel 23, for the time period designated by reference symbol Tμ, the transistor TR2 is turned ON to cause the charge current to flow into the organic EL device 8 side terminal of the signal level holding capacitor C1 in the state in which the signal line SIG side voltage of the signal level holding capacitor C1 is held at the signal level Vsig on the signal line SIG. As a result, the voltage across the terminals of the signal level holding capacitor C1 is reduced by the degree corresponding to the mobility of the transistor TR2, thereby preventing the dispersion in the emission luminance due to the dispersion in the mobility of the transistor TR2.

In the pixel 23, after a lapse of the given time period Tμ, the transistor TR1 is turned OFF by the write signal WS, and the signal level Vsig of the signal on the signal line SIG is held in the signal level holding capacitor C1, thereby starting the emission time period. It is noted that from these facts, the drive signal Ssig for the signal line SIG is repeated in a state in which the fixed potential Vofs is held between the signal levels Vsig which represent the gradations in order of the pixels 23 connected to one signal line.

Now, in the polysilicon TFT or the like, as shown in FIG. 16, when the gate voltage Vg is held as a positive voltage with respect to the source voltage Vs, the threshold voltage Vth increases with time. Contrary to this, as shown in FIG. 17, when the gate voltage Vg is held as a negative voltage with respect to the source voltage Vs, the threshold voltage Vth decreases with time. Note that, in FIGS. 16 and 17, curves designated by reference symbols L3 and L4 represent an initial state and a state after the variation with age, respectively.

On the other hand, in the pixel 23, as shown in FIGS. 7A to 7E, the transistor TR1 is set in the ON state by the write signal WS only for a limited time period within a non-emission time period. As a result, the threshold voltage Vth of the transistor TR1 decreases step by step due to the long term use. It is noted that the non-emission time period corresponds to several time periods for the horizontal scanning of the time period of one frame. When the threshold voltage Vth of the transistor TR1 decreases step by step in such a manner, as shown in FIG. 18, the time period for which the transistor TR1 is held in the ON state increases to a time period of TON. As a result, in the pixel 23, the time periods Tth1 to Tth3 for which the threshold voltage of the transistor TR2 is corrected, and the time period Tμ for which the mobility of the transistor TR2 is corrected are lengthened, which results in the problem that the mobility of the transistor TR2 is over-corrected. This leads to that the color heterogeneity, of the image quality, such as the shading is generated due to the variation with age. In addition, when the threshold voltage Vth of the transistor TR1 is over-reduced, in the end, the transistor TR1 cannot be set in the ON state, which results in the problem that the gradation of the pixel 23 cannot be set.

As a result, the display device having the configuration in the related art involves such a problem that the image quality deteriorates due to the variation with age, and further the gradation cannot be set.

SUMMARY OF THE INVENTION

The present invention has been made in consideration of the respects described above, and it is therefore desirable to provide a display device which is capable of effectively avoiding a phenomenon that an image quality deteriorates due to a variation with age, and a gradation cannot be set, and a method of driving the same.

In order to attain the desire described above, according to an embodiment of the present invention, there is provided a display device including a display portion formed by disposing pixels in a matrix, a horizontal drive circuit and a vertical drive circuit, signal lines and scanning lines of the display portion being driven by the horizontal drive circuit and the vertical drive circuit, thereby displaying a desired image on the display portion. The pixel includes: a light emitting device; a signal level holding capacitor; a writing transistor for receiving a write signal outputted from the vertical drive circuit at its gate, and performing an ON/OFF operation by the write signal, thereby setting a voltage across the terminals of the signal level holding capacitor at a signal level of a signal on corresponding one of the signal lines; and a driving transistor for driving the light emitting device to emit a light in accordance with the voltage across the terminals of the signal level holding capacitor. The vertical drive circuit sets a signal level of the write signal for an entire time period or a partial time period of a time period for which no influence is exerted on the drive for the light emitting device in a non-emission time period for which the light emitting device is stopped to emit a light at a signal level of the write signal on a shorter time period side in other time periods except for the entire time period or the partial time period.

In the display device according to the embodiment of the present invention, a change in threshold voltage of the writing transistor is corrected in accordance with the setting of the signal level of the write signal for the entire or partial time period.

In the display device according to the embodiment of the present invention, in the pixel, both the terminals of the signal level holding capacitor are connected to a gate and a source of the driving transistor, respectively. For the non-emission time period, charges accumulated in the signal level holding capacitor are discharged through the driving transistor after a potential across both the terminals of the signal level holding capacitor is set at a predetermined potential, thereby setting a threshold voltage of the driving transistor in the signal level holding capacitor. After that, the voltage across the terminals of the signal level holding capacitor is corrected with the threshold voltage of the driving transistor by setting a voltage at the one terminal of the signal level holding capacitor at the signal level of the signal on the signal line by the writing transistor, thereby preventing a dispersion in an emission luminance of the light emitting device due to a dispersion in the threshold voltage of the driving transistor.

In the display device according to the embodiment of the present invention, in the pixel, for the non-emission time period, the driving transistor is turned ON to charge the other terminal of the signal level holding capacitor with electricity by the driving transistor after the voltage at the one terminal of the signal level holding capacitor is set at the signal level on the signal line by the writing transistor, thereby preventing the dispersion in the emission luminance of the light emitting device due to a dispersion in a mobility of the driving transistor.

According to another embodiment of the present invention, there is provided a method of driving a display device including a display portion formed by disposing pixels in a matrix, a horizontal drive circuit and a vertical drive circuit, signal lines and scanning lines of the display portion being driven by the horizontal drive circuit and the vertical drive circuit, thereby displaying a desired image on the display portion. The pixel includes: a light emitting device; a signal level holding capacitor; a writing transistor for receiving a write signal outputted from the vertical drive circuit at its gate, and performing an ON/OFF operation by the write signal, thereby setting a voltage across the terminals of the signal level holding capacitor at a signal level on corresponding one of the signal lines; and a driving transistor for driving the light emitting device to emit a light in accordance with the voltage across the terminals of the signal level holding capacitor. The driving method includes the step of setting a signal level of the write signal for an entire time period or a partial time period of a time period for which no influence is exerted on the drive for the light emitting device in a non-emission time period for which the light emitting device is stopped to emit a light at a signal level of the write signal on a shorter time period side in other time periods except for the entire time period or the partial time period.

According to the embodiment or another embodiment of the present invention, the signal level of the write signal for the entire time period or the partial time period of the time period for which no influence is exerted on the drive for the light emitting device in the non-emission time period for which the light emitting device is stopped to emit the light is set at the signal level of the write signal on the shorter time period side in other time periods except for the entire time period or the partial time period. As a result, it is possible to reduce the bias of the signal level in the write signal. Accordingly, the change in threshold voltage of the writing transistor due to the variation with age can be prevented as compared with the case of the related art. As a result, it is possible to efficiently avoid the phenomenon that the image quality deteriorates due to the variation with age resulting from the change in threshold voltage, and the gradation cannot be set.

According to the present invention, it is possible to efficiently avoid the phenomenon that the image quality is deteriorated due to the variation with age resulting from the change in threshold voltage of the writing transistor, and the gradation cannot be set.

DETAILED DESCRIPTION OF THE PREFERRED EMBODIMENTS

Preferred embodiments of the present invention will be described in detail hereinafter with reference to the accompanying drawings.

Embodiment 1

(1) Constitution of Embodiment 1

Figures 7A, 7B, 7C, 7D, 7E:
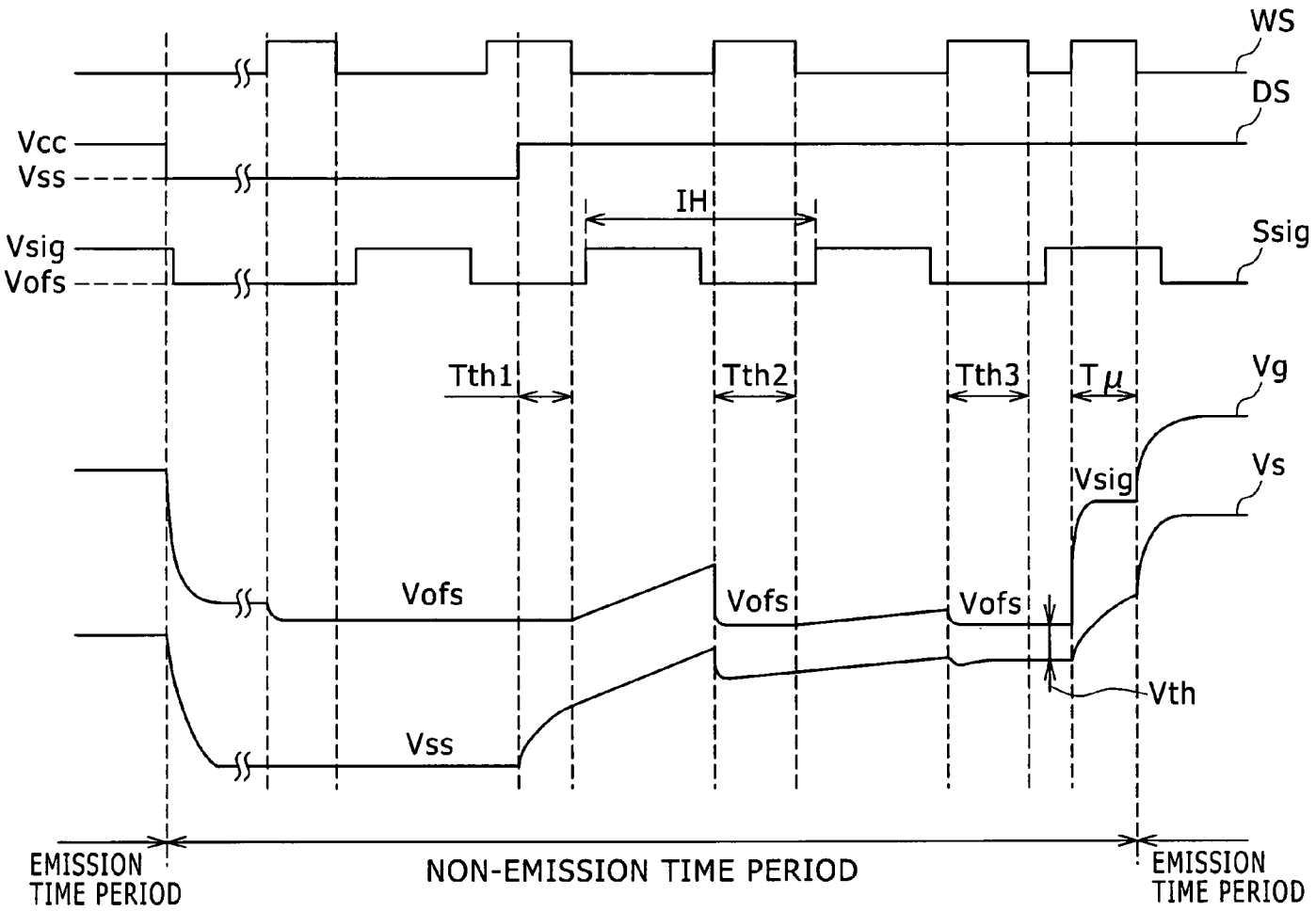
FIGS. 7A to 7E are a time chart explaining an operation of the display device shown in FIG. 6.
Figure 8:
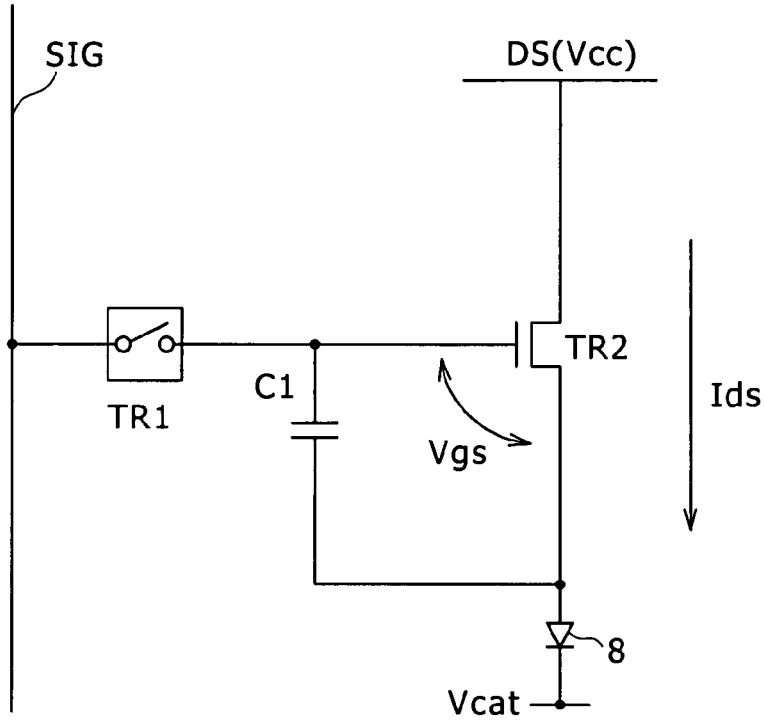
FIG. 8 is a circuit diagram showing a connection state for setting in a pixel for an emission time period shown in FIGS. 7A to 7E.

FIGS. 1A to 1F are a time chart explaining an operation for driving a pixel circuit in a display device according to Embodiment 1 of the present invention in comparison with the case of FIG. 7. The display device of Embodiment 1 is configured in the same manner as that in the display device previously described except that the write scanning circuit 24A generates the write signal WS shown in FIG. 1A, thereby driving the pixel 23.

Figure 9:
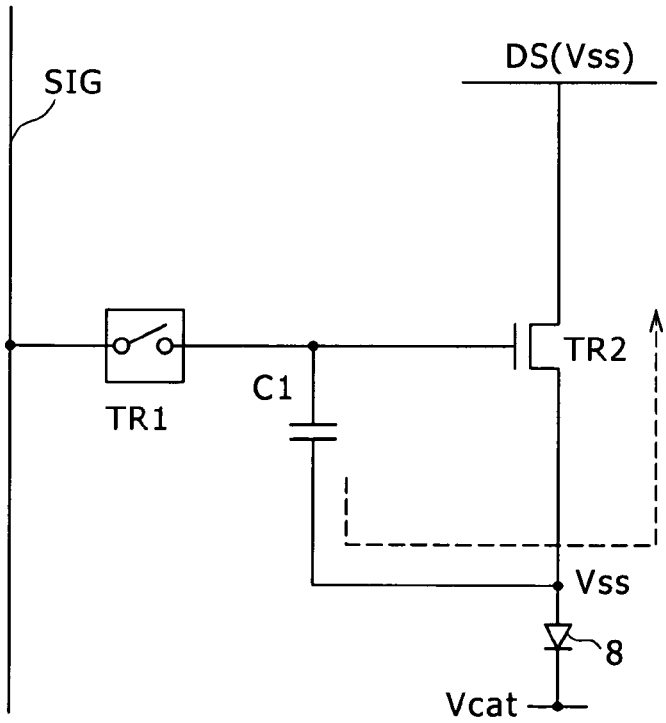
FIG. 9 is a circuit diagram showing a connection state next to the connection state shown in FIG. 8.
Figure 10:
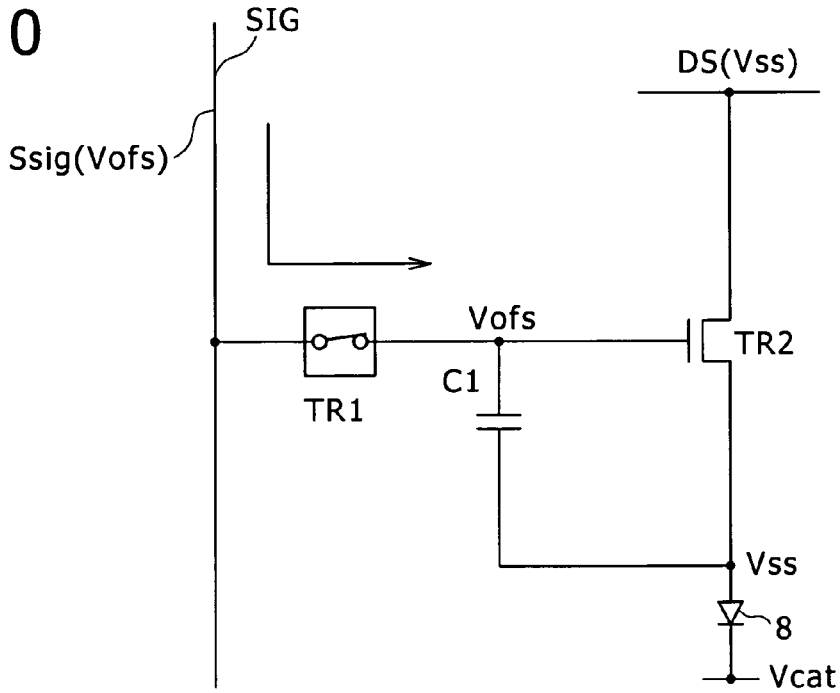
FIG. 10 is a circuit diagram showing a connection state next to the connection state shown in FIG. 9.
Figure 11:
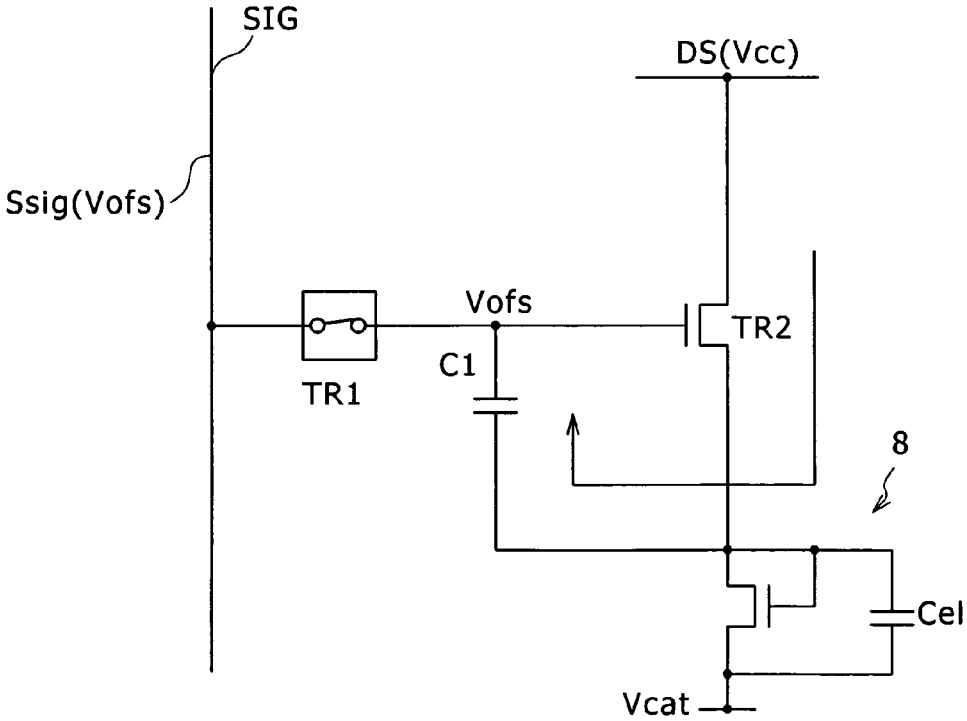
FIG. 11 is a circuit diagram showing a connection state next to the connection state shown in FIG. 10.
Figure 12:
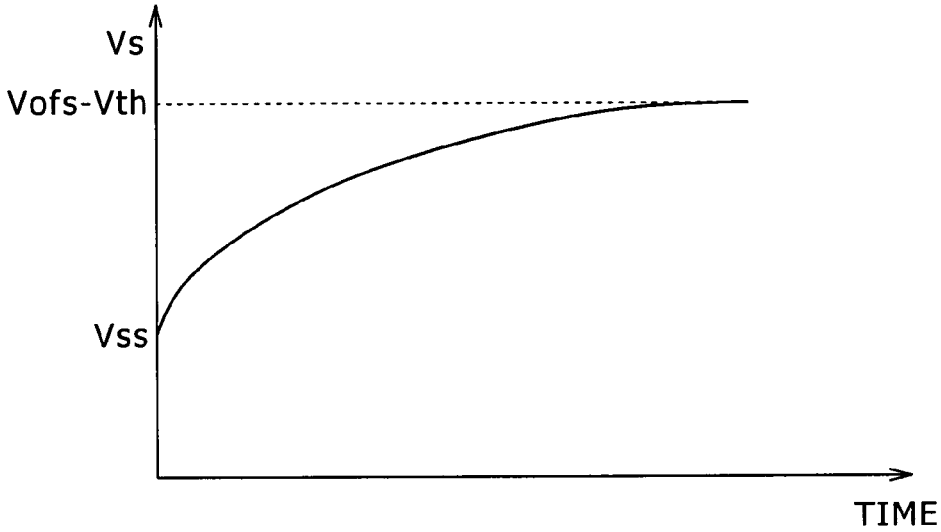
FIG. 12 is a graph showing a characteristic curve explaining correction for a threshold voltage of the N-channel TFT transistor.
Figure 13:
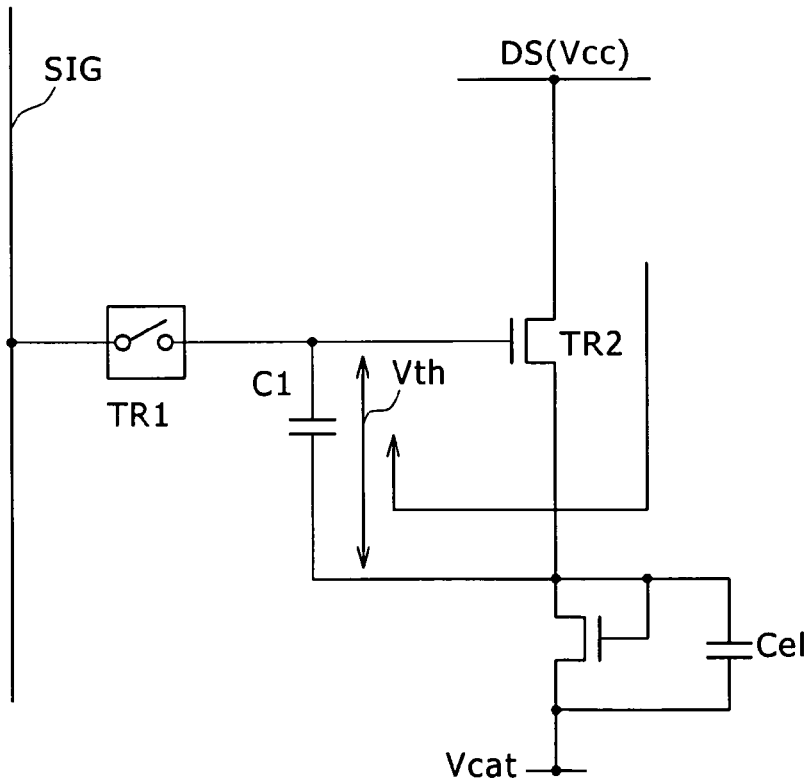
FIG. 13 is a circuit diagram showing a connection state next to the connection state shown in FIG. 11.
Figure 14:
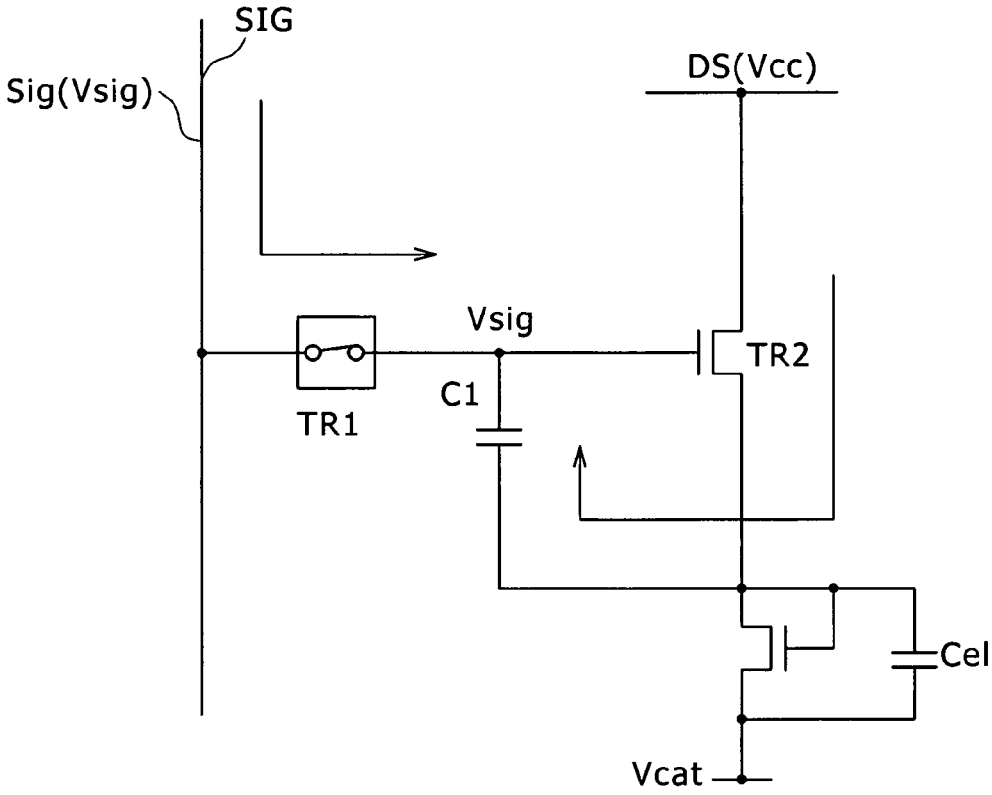
FIG. 14 is a circuit diagram showing a connection state next to the connection state shown in FIG. 13.
Figure 15:
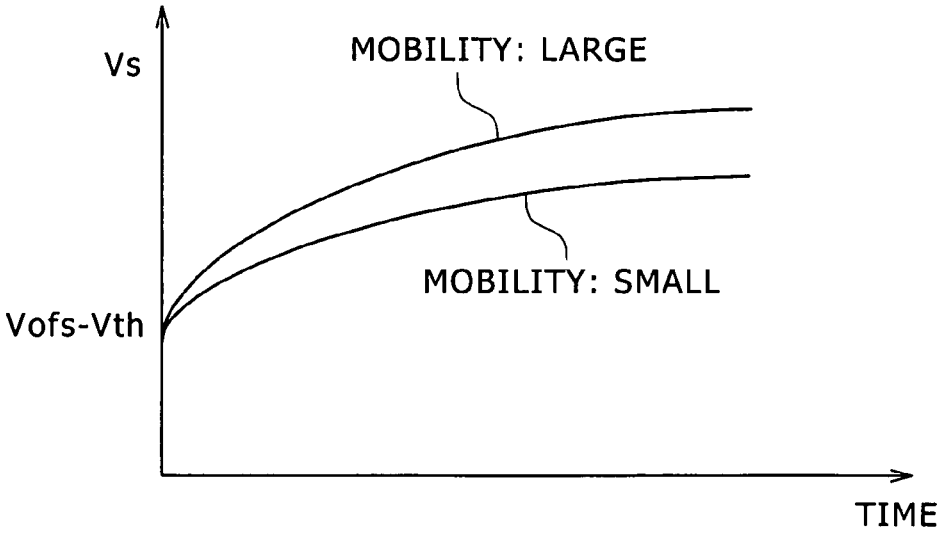
FIG. 15 is a graph showing characteristic curves explaining correction for a mobility of the N-channel TFT transistor.

The write scanning circuit 24A of the display device of Embodiment 1 sets the signal level of the write signal for a time period T for which no influence is exerted on the drive for the pixel 23 at all within the non-emission time period for which the organic EL device 8 is stopped to emit the light at the signal level on a shorter time period side in other time periods except for the time period T. Therefore, in Embodiment 1 shown in FIGS. 1A to 1F, the write signal WS is held at an H level for a time period ranging from a time point when the non-emission time period starts to discharge the charges accumulated in the signal level holding capacitor C1 up to a time point just before the correction for the threshold voltage is started (refer to FIG. 9). It is noted that in FIGS. 1A to 1F, the write signal WS shown in FIGS. 7A to 7E is indicated by a dotted line for comparison with the case of FIGS. 1A to 1F.

(2) Operation of Embodiment 1

With the configuration described above, in the display device of Embodiment 1 (refer to FIGS. 6 to 15), the horizontal drive circuit and the vertical drive circuit successively drive the signal lines SIG and the scanning lines SCN in units of lines, whereby the signal levels Vsig of the signals on the signal lines SIG are set in the pixels 23 of the display portion 22, respectively. Also, the organic EL devices 8 of the pixels 23 emit lights, respectively, in accordance with the signal levels Vsig thus set, thereby displaying a desired image on the display portion 22.

That is to say, in the display device of Embodiment 1, for the non-emission time period, the voltage at one terminal of the signal level holding capacitor C1 is set at the signal level Vsig on the signal line SIG. On the other hand, for the emission time period, the organic EL device 8 is driven by the transistor TR2 in accordance with the gate to source voltage Vgs based on the voltage across the terminals of the signal level holding capacitor C1. As a result, in the display device of Embodiment 1, the organic EL devices 8 of the pixels 23 emit the lights with the emission luminances corresponding to the signal levels Vsig on the signal lines SIG, respectively.

In the display device of Embodiment 1, for the non-emission time period, firstly, the voltages at the both terminals of the signal level holding capacitor C1 are set at the fixed potentials Vofs and Vss, respectively. After that, the threshold voltage Vth of the transistor TR2 is set at the signal level holding capacitor C1 by discharging the charges accumulated in the signal level holding capacitor C1 through the transistor TR2 for driving the organic EL device 8 (refer to the time periods Tth1, Tth2 and Tth3 of FIGS. 7A to 7E). As a result, there is corrected the dispersion in the emission luminance due to the dispersion in the threshold voltage Vth of the transistor TR2.

In addition, thereafter, the transistor TR1 is set in the ON state by the write signal WS to connect the signal line SIG side terminal of the signal level holding capacitor C1 to the signal line SIG. In this state, the transistor TR2 is turned ON to charge the other terminal of the signal level holding capacitor C1 with electricity (for the time period Tμ of FIGS. 7A to 7E). As a result, there is corrected the dispersion in the emission luminance due to the dispersion in the mobility of the transistor TR2.

In the display device of Embodiment 1, after a lapse of a given time, the transistor TR2 is switched from the ON state over to the OFF state by the write signal WS. As a result, the signal level Vsig on the signal line SIG is sampled and held in the signal level holding capacitor C1, and the emission luminance of the organic EL device 8 is set.

As a result, in the display device of Embodiment 1, when the threshold voltage Vth changes in the transistor TR1 through which the signal level holding capacitor C1 is connected to the signal line SIG, the time period Tμ changes for which the mobility of the transistor TR2 is corrected. Also, the dispersion in the mobility is over-corrected, which results in the problem that the image quality deteriorates and the gradation cannot be set.

Figure 16:
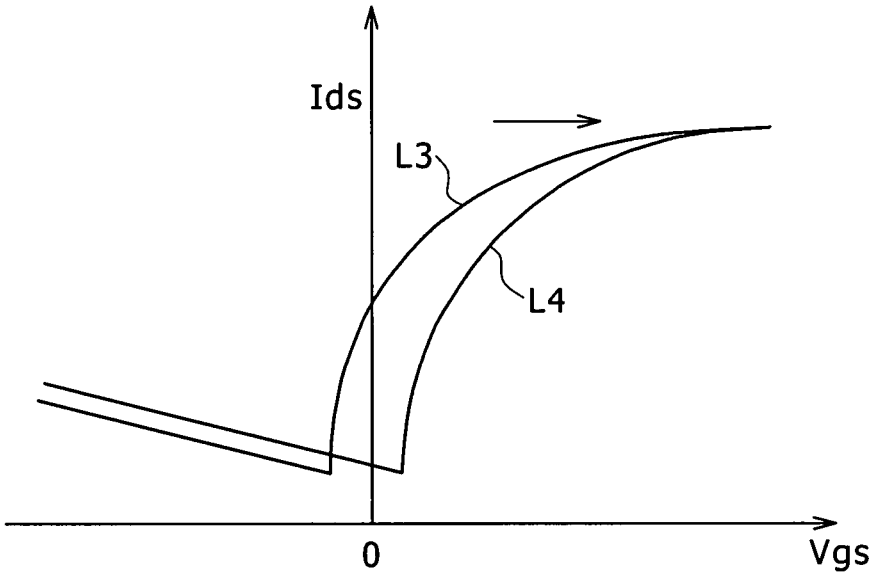
FIG. 16 is a graph showing characteristic curves explaining a variation with age of the threshold voltage of the N-channel TFT transistor.
Figure 17:
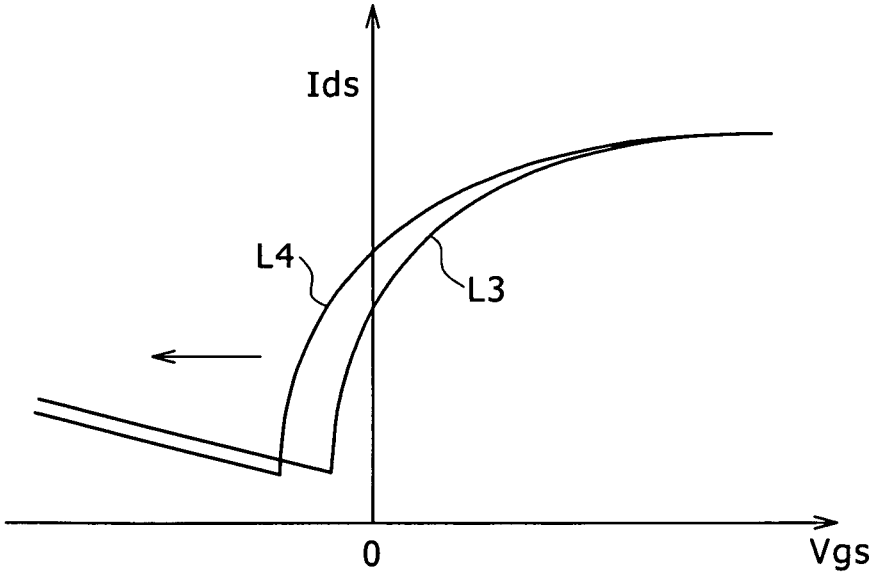
FIG. 17 is a graph showing characteristic curves explaining a variation with age of the threshold voltage of the N-channel TFT transistor due to a polarity opposite to that in the case of FIG. 16.
Figure 18:
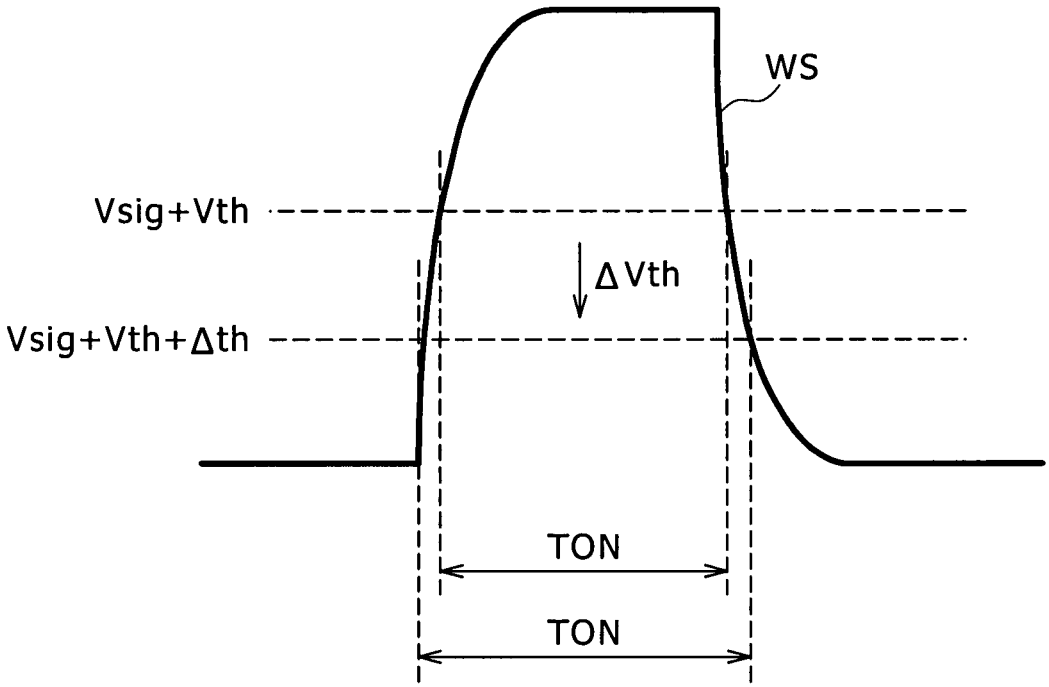
FIG. 18 is a time chart explaining an influence of the mobility exerted on correction for dispersion due to a variation with age of the threshold voltage of the N-channel TFT transistor.

On the other hand, in the polysilicon TFTs or the amorphous transistors constituting the transistors TR1 and TR2, the threshold voltage Vth deteriorates with time depending on the gate voltage Vg with respect to the source voltage Vs (refer to FIGS. 16 and 17). Therefore, when the signal level of the write signal WS is merely made to rise only for the time periods Tth1, Tth2 and Tth3 for which the voltage across the terminals of the signal level holding capacitor C1 is set at the threshold voltage Vth of the transistor TR1, and for the time period Tμ for which the mobility is corrected, the threshold voltage Vth is reduced in the transistor TR1 as an target of the output of the write signal WS due to the variation with age, and the time period Tμ for which the mobility is corrected changes to be gradually lengthened. As a result, the image quality deteriorates and the gradation cannot be set.

In consideration of the foregoing, in Embodiment 1, for the time period for which no influence is exerted on the drive for the organic EL device 8 (refer to FIGS. 1A to 1F) within the non-emission time period for which the organic EL device 8 is stopped to emit the light is set at the signal level on the shorter time period side in other time periods except for the time period (T). That is to say, in this case, for the time period T in FIGS. 1A to 1F, the signal level of the write signal WS is set at the H level.

As a result, in the display device of Embodiment 1, the signal level of the write signal WS can be made to rise for a longer time period as compared with the case where the signal level of the write signal WS is merely made to rise only for the time periods Tth1, Tth2 and Tth3 for which the voltage across the terminals of the signal level holding capacitor C1 is set at the threshold voltage Vth of the transistor TR1, and for the time period Tμ for which the mobility is corrected. Thus, the bias of the signal level of the write signal WS can be reduced. Therefore, the change in threshold voltage of the writing transistor due to the variation with age can be prevented as compared with the case in the related art. As a result, it is possible to effectively avoid the phenomenon that the image quality deteriorates due to the variation with age resulting from the change in threshold value, and the gradation cannot be set.

It is noted that in the pixel having the organic EL device 8, the H level of the write signal WS is about 30 V, whereas the L level of the write signal WS is about −3 V. On the other hand, the change in threshold voltage Vth due to the variation with age has the features that the threshold voltage Vth changes due to not only the polarity of the gate to source voltage, but also the voltage value thereof.

As a result, it seems likely that when the bias of the signal level of the write signal WS is perfectly removed, that is, when the time period for which the signal level rises in the write signal WS, and the time period for which the signal level falls in the write signal WS are made approximately equal to each other, the variation with age of the threshold Vth of the transistor TR1 due to the bias of the signal level of the write signal WS can be perfectly prevented. However, even when the bias still remains as in Embodiment 1, the variation with age of the threshold voltage Vth of the transistor TR1 can be sufficiently prevented in terms of practical use.

As a result, even when the time period for which the signal level is held at the H level is still shorter than that for which the signal level is held at the L level even in the write signal WS as in Embodiment 1, the variation with age of the threshold voltage Vth of the transistor TR1 can be sufficiently prevented in terms of practical use.

(3) Effect of Embodiment 1

According to Embodiment 1 of the present invention, for the entire time period for which no influence is exerted on the drive for the light emitting device within the non-emission time period for which the light emitting device is stopped to emit the light, the signal level of the write signal is set at the signal level on the shorter time period side in other time periods. As a result, it is possible to effectively avoid the phenomenon that the image quality deteriorates due to the variation with age resulting from the change in threshold value, and the gradation cannot be set.

That is to say, the change in threshold voltage of the writing transistor is corrected in accordance with the setting of the signal level of the write signal, whereby it is possible to effectively avoid the phenomenon that the image quality deteriorates due to the variation with age resulting from the change in threshold value, and the gradation cannot be set.

In addition, in each of the pixels, the threshold voltage of the driving transistor is set in the signal level holding capacitor, so that the dispersion in the emission luminance due to the dispersion in the threshold voltage is prevented, thereby making it possible to obtain the displayed image having the high image quality.

In addition, the driving transistor is turned ON to charge the other terminal of the signal level holding capacitor with electricity, the dispersion in the mobility of the driving transistor is corrected, and the dispersion in the emission luminance of the light emitting device due to the dispersion in the mobility of the driving transistor is prevented. As a result, it is possible to obtain the displayed image having the higher image quality. Also, it is possible to prevent the change in time period for which the dispersion in the mobility due to the change in threshold voltage Vth of the driving transistor is corrected. As a result, it is possible to obtain the displayed image having the higher image quality.

Embodiment 2

It is noted that although in Embodiment 1 described above, the description has been given so far with respect to the case where for the entire time period for which no influence is exerted on the drive for the light emitting device within the non-emission time period, the signal level of the write signal is set at the signal level on the shorter time period side in other time periods, the present invention is by no means limited thereto. That is to say, in the case where the variation with age of the threshold voltage of the writing transistor is over-corrected, or the like, for a partial time period as well for which no influence is exerted on the drive for the light emitting device within the non-emission time period, the signal level of the write signal may be set at the signal level on the shorter time period side.

Figures 1A, 1B, 1C, 1D, 1E, 1F:
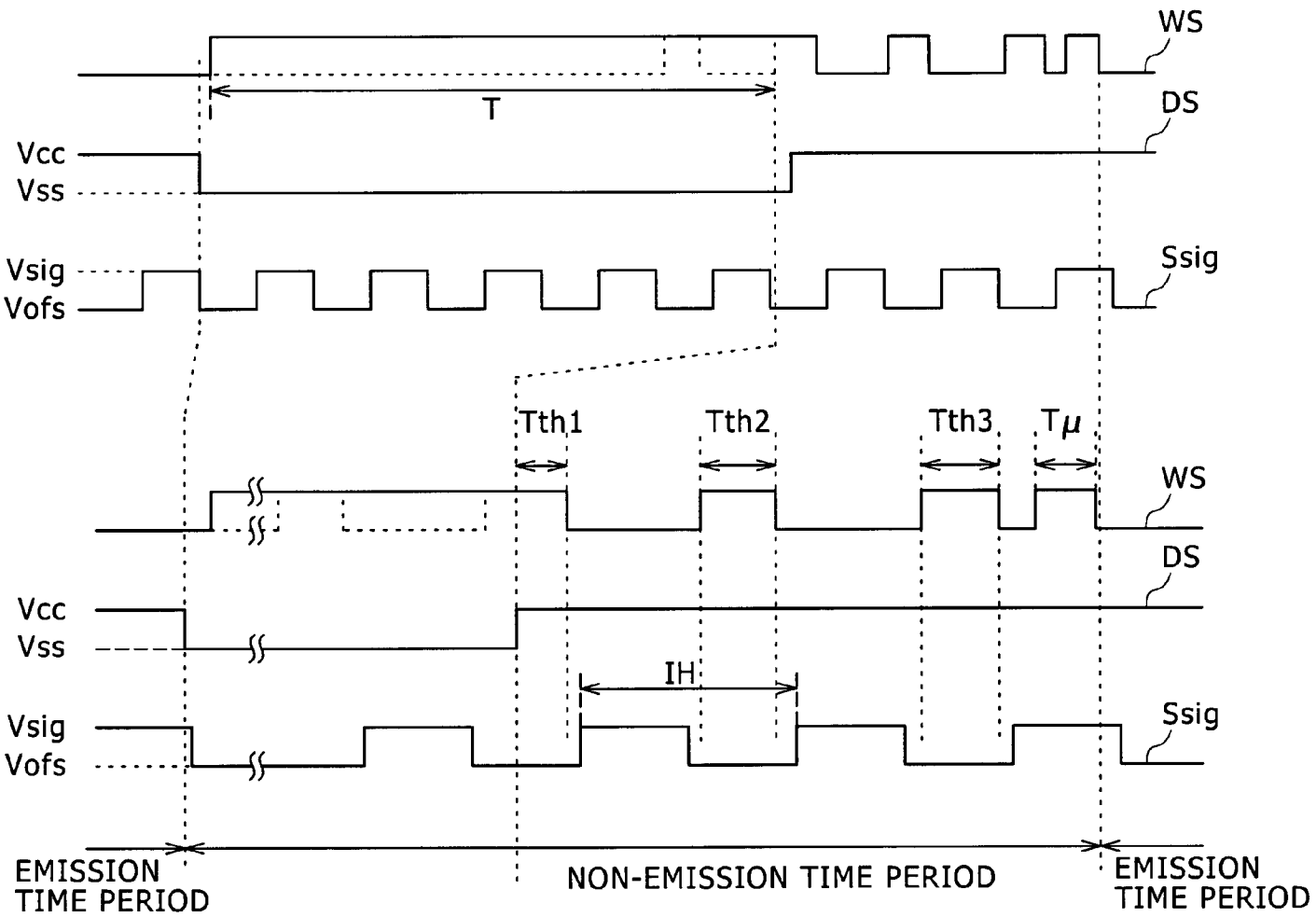
FIGS. 1A to 1F are a time chart explaining an operation for driving each of pixels in a display device according to Embodiment 1 of the present invention.
Figure 2:
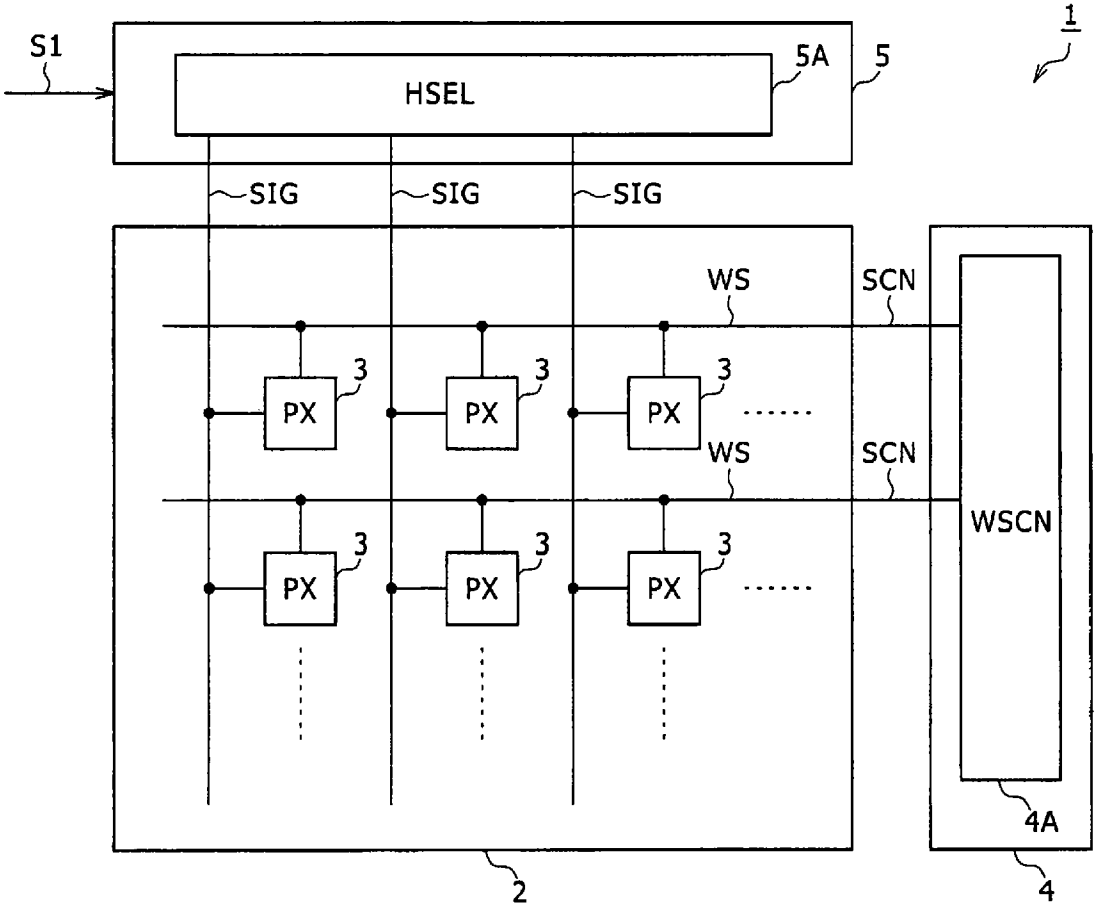
FIG. 2 RELATED ART
FIG. 2 is a block diagram showing a display device in the related art.
Figure 3:
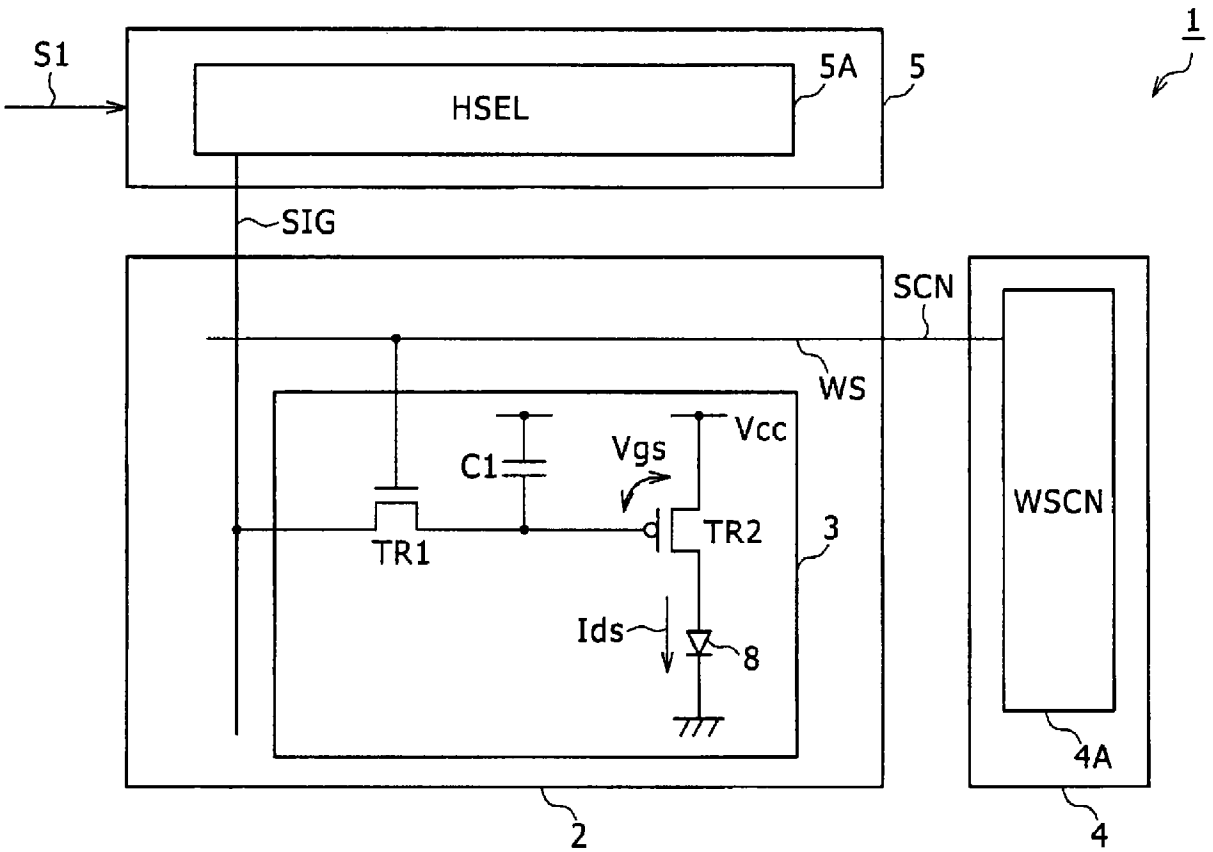
FIG. 3 RELATED ART
FIG. 3 is a block diagram, partly in circuit, showing a configuration of the display device in detail shown in FIG. 2.
Figure 4:
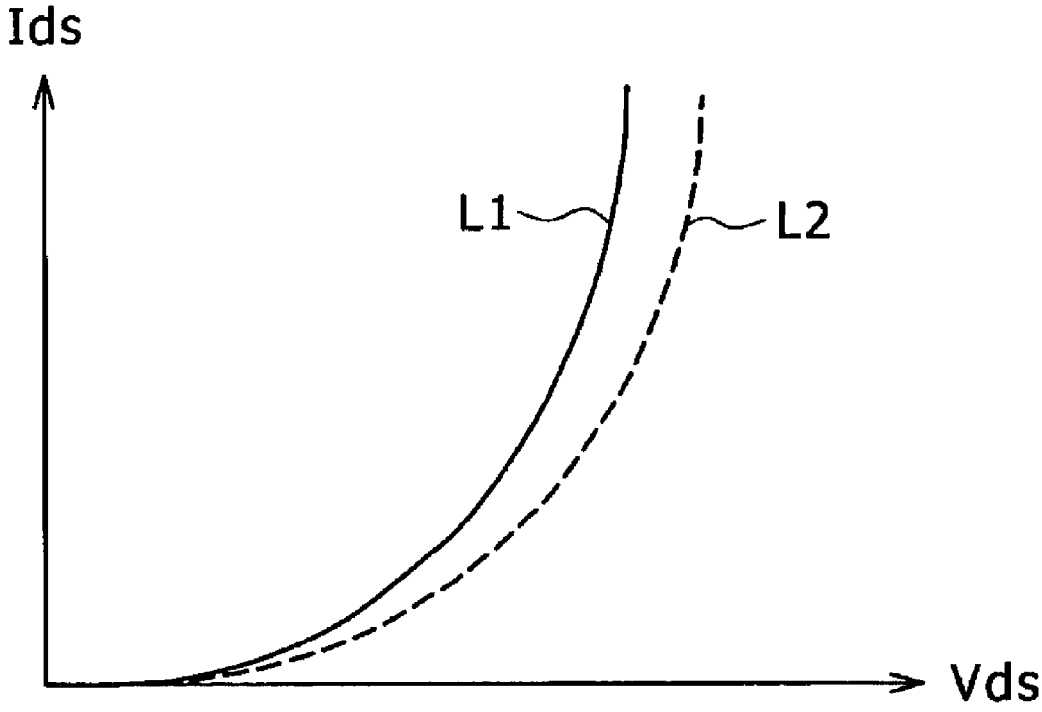
FIG. 4 RELATED ART
FIG. 4 is a graph showing characteristic curves explaining a variation with age of an organic EL device shown in FIG. 3.
Figure 5:
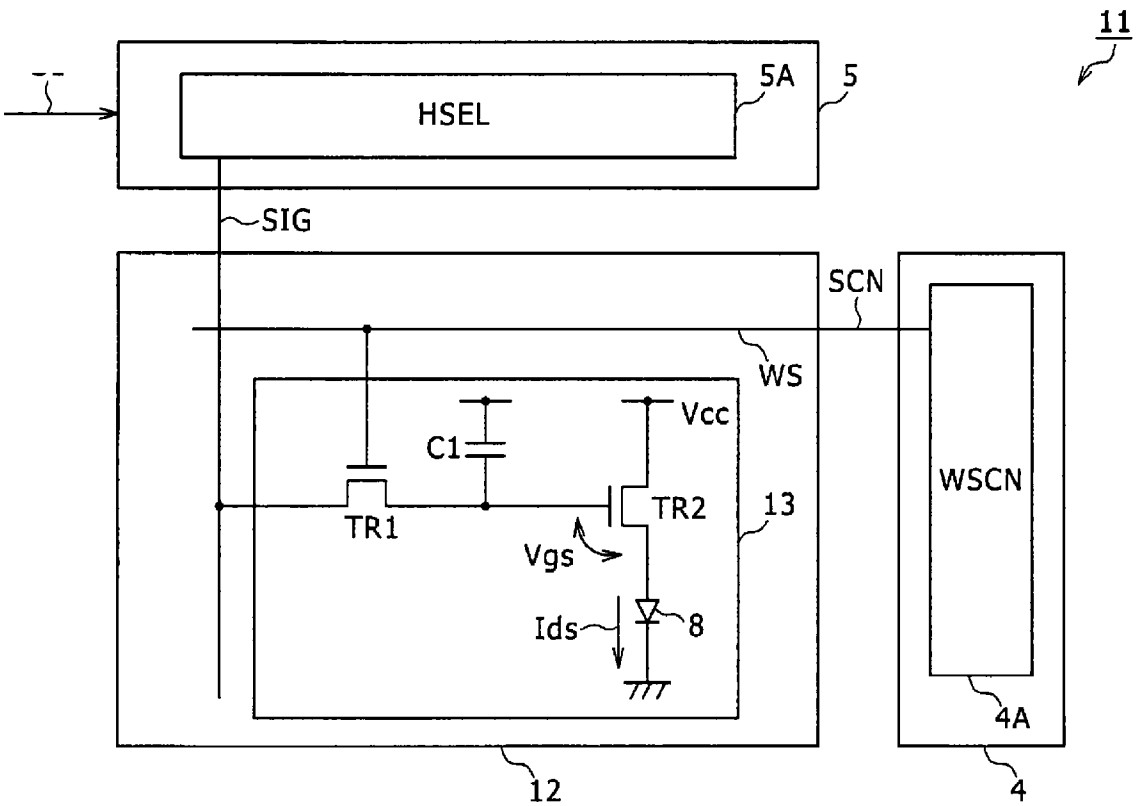
FIG. 5 RELATED ART
FIG. 5 is a block diagram, partly in circuit, showing the case where an N-channel TFT transistor is used in the configuration of the display device shown in FIG. 3.
Figure 6:
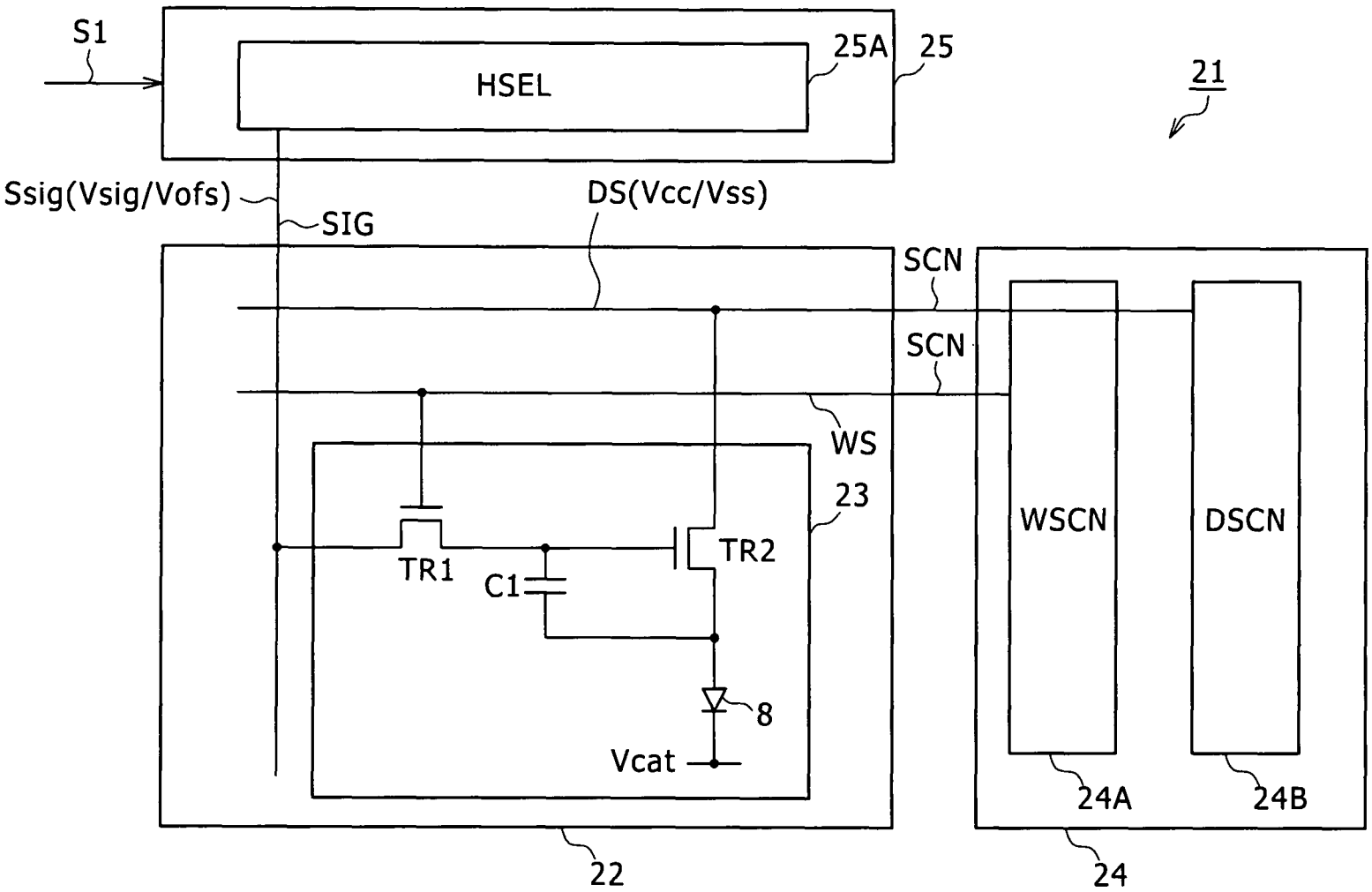
FIG. 6 is a block diagram, partly in circuit, showing a display device which is devised by using the N-channel TFT transistor.

In addition, although in Embodiment 1 described above, the description has been given with respect to the case where the pixel circuit having the circuit configuration shown in FIG. 6 is driven with timing shown in FIGS. 7A to 7E, the present invention is by no means limited thereto. That is to say, the present invention can also be generally applied to the case where the pixel is configured to have any of various circuit configurations, the case where the pixel is driven at any of the various timings, and the like.

In addition, although in Embodiment 1 described above, the description has been given with respect to the case where each of the transistors is formed in the form of the polysilicon TFT, the present invention is by no means limited thereto. That is to say, the present invention can also be generally applied to the case where each of the transistors is formed in the form of any of various transistors.

In addition, although in Embodiment 1 described above, the description has been given with respect to the case where the signal level holding capacitor is connected to the signal line through the N-channel TFT transistor, the present invention is by no means limited thereto. That is to say, the present invention can also be generally applied to the case where the signal level holding capacitor is adapted to be connected to the signal line through the P-channel TFT transistor.

Also, although in Embodiment 1 described above, the description has been given with respect to the case where the organic EL device is used as the light emitting device, the present invention is by no means limited thereto. That is to say, the present invention can also be generally applied to the case where any of various current drive type light emitting devices is used as the light emitting device.

The present invention, for example, can be applied to an active matrix type display device having pixels each of which is composed of the organic EL device using the polysilicon TFT.

What is claimed is:

1. A display device comprising a display portion formed by disposing pixels in a matrix, a horizontal drive circuit and a vertical drive circuit, signal lines and scanning lines of said display portion being driven by said horizontal drive circuit and said vertical drive circuit, for displaying a desired image on said display portion, wherein respective ones of said pixels includes:

a light emitting device;

a signal level holding capacitor;

a writing transistor for receiving a write signal outputted from said vertical drive circuit at a gate of said writing transistor, and performing an ON/OFF operation by said write signal, for setting a voltage across terminals of said signal level holding capacitor at a signal level of a corresponding one of said signal lines; and a driving transistor for driving said light emitting device to emit light in accordance with the voltage across said terminals of said signal level holding capacitor, and said write signal is set for an ON operation of said writing transistor throughout a first time period, said first time period starting at a beginning of a non-emission time period of said light emitting device and ending prior to a beginning of a plurality of correction periods occurring in said non-emission time period of said light emitting device, a sum of said plurality of correction periods being shorter than said first time period, each of said plurality of correction periods contributing to a correction for a threshold voltage of said driving transistor.

2. The display device according to claim 1, wherein in said pixel, both said terminals of said signal level holding capacitor are connected to a gate and a source of said driving transistor, respectively;

for the non-emission time period, charges accumulated in said signal level holding capacitor are discharged through said driving transistor after a potential across both said terminals of said signal level holding capacitor is set at a predetermined potential, for setting the threshold voltage of said driving transistor in said signal level holding capacitor; and the voltage across said terminals of said signal level holding capacitor is corrected with the threshold voltage of said driving transistor by setting a voltage at the one terminal of said signal level holding capacitor at the signal level of the signal on said signal line by said writing transistor, for preventing a dispersion in an emission luminance of said light emitting device due to a dispersion in the threshold voltage of said driving transistor.

3. The display device according to claim 2, wherein in said pixel, for the non-emission time period, said driving transistor is turned ON to charge the other terminal of said signal level holding capacitor with electricity by said driving transistor after the voltage at the one terminal of said signal level holding capacitor is set at the signal level on said signal line by said writing transistor, for preventing the dispersion in the emission luminance of said light emitting device due to a dispersion in a mobility of said driving transistor.

4. A method of driving a display device including a display portion formed by disposing pixels in a matrix, a horizontal drive circuit and a vertical drive circuit, signal lines and scanning lines of said display portion being driven by said horizontal drive circuit and said vertical drive circuit, for displaying a desired image on said display portion, wherein respective ones of said pixels includes:

a light emitting device;

a signal level holding capacitor;

a writing transistor for receiving a write signal outputted from said vertical drive circuit at a gate of said writing transistor, and performing an ON/OFF operation by said write signal, for setting a voltage across the terminals of said signal level holding capacitor at a signal level of a signal a corresponding one of said signal lines; and a driving transistor for driving said light emitting device to emit light in accordance with the voltage across said terminals of said signal level holding capacitor, said driving method comprising;

setting said write signal for an ON operation of said writing transistor throughout a first time period, said first time period starting at a beginning of a non-emission time period of said light emitting device and ending prior to a beginning of a plurality of correction periods occurring in said non-emission time period of said light emitting device, a sum of said plurality of correction periods being shorter than said first time period, each of said plurality of correction periods contributing to a correction for a threshold voltage of said driving transistor.

* * * * *